US007648408B2

(12) United States Patent
Lung

(10) Patent No.: US 7,648,408 B2
(45) Date of Patent: Jan. 19, 2010

(54) USER CONSTRUCTED MULTI COMPONENT BRA SYSTEM

(75) Inventor: Cheung Sui Lung, Hong Kong (CN)

(73) Assignee: Hung Hon Industrial Co. Ltd., Kwai Chung, Hong Kong (CN)

( * ) Notice: Subject to any disclaimer, the term of this patent is extended or adjusted under 35 U.S.C. 154(b) by 0 days.

(21) Appl. No.: 11/998,760

(22) Filed: Nov. 30, 2007

(65) Prior Publication Data

US 2009/0075562 A1 Mar. 19, 2009

(30) Foreign Application Priority Data

Sep. 14, 2007 (CN) ..... 2007 1 0030239
Sep. 14, 2007 (CN) ..... 2007 2 0057004

(51) Int. Cl.
*A41C 3/02* (2006.01)
*A41C 3/06* (2006.01)

(52) U.S. Cl. ..... 450/58; 450/86; 450/88; 2/336; 24/198; 24/197; 24/200

(58) Field of Classification Search ..... 450/86, 450/85, 87, 88, 83, 82, 79, 71, 77, 17, 18, 450/23, 25, 26, 28, 63, 58; 2/67, 68, 311, 2/312, 310, 338, 336; 24/197, 198, 200
See application file for complete search history.

(56) References Cited

U.S. PATENT DOCUMENTS 2,590,915 A * 4/1952 Allison ..... 450/82
2,638,596 A * 5/1953 Fridolph ..... 450/82
2,668,954 A * 2/1954 Frohlich ..... 450/82
2,715,225 A * 8/1955 Gould ..... 450/58
2,954,031 A * 9/1960 Froehlich ..... 450/48
3,040,750 A * 6/1962 Hurwitz ..... 450/58
3,311,112 A * 3/1967 Murray ..... 450/1
3,653,075 A * 4/1972 Gluckin et al. ..... 2/338
4,501,026 A * 2/1985 Seneca ..... 2/308
6,006,364 A * 12/1999 Newsom et al. ..... 2/323
6,123,601 A * 9/2000 Hildebrandt ..... 450/82
6,135,853 A * 10/2000 Hopson ..... 450/86
6,390,885 B1 * 5/2002 Brooks ..... 450/1
6,938,440 B2 * 9/2005 Smith ..... 63/1.18
6,994,606 B2 * 2/2006 Li ..... 450/82
7,100,250 B2 * 9/2006 Fildan et al. ..... 24/591.1

* cited by examiner

*Primary Examiner*—Gloria Hale
(74) *Attorney, Agent, or Firm*—Curtis L. Harrington; Kathy E. Harrington; Harrington & Harrington

(57) ABSTRACT

A user selectable interchangeable bra system enables user to customize the selection, style, construction, and usage of a bra both through component purchase and interchangeable fit. An infinite number of different size, color and fits are possible, as well as underwire interchangeableness. The center connector can be selected to provide for user selectable cup separation. Buckle type shoulder strap fittings can be provided with a tiny loop to support body jewelry, and because the shoulder straps are reversible, the body jewelry can be worn on the front or back upper chest, especially where the jewelry can appear to come from underneath the dress to give an appearance of a much more extensive jewelry extent.

11 Claims, 5 Drawing Sheets

USER CONSTRUCTED MULTI COMPONENT BRA SYSTEM

This application relies for priority upon CHINA patent application: No. 200720057004.9 for invention No. 200710030239.3 filed on Sep. 14, 2007.

BACKGROUND OF THE INVENTION

This invention relates to a user selected and assembled bra system which enables users to customize the selection, style, construction, and usage. The selection and customization can occur at the point of purchase, while the interchangeableness and further customization of the user can occur at home based upon the total number of different types of components available to the user. Interchangeable customization can be based upon component sizes, shapes and colors, and compatibility with outer wear, to name a few.

BACKGROUND OF THE INVENTION

Women's underwear and particularly bras have become a part of fashionable dressing. As more and more types, functions and designs of bras are available in the market, customers naturally attempt to find the optimum combination of require purchasing more underwear to meet their special needs. On the other hand, most of the structure and accessories of the underwear in the market are standardized. Manufacturers who seek to include a number of different type, and sometimes mutually exclusive options must manufacture an overly large number of models to try to maximize the probability that a user can purchase a model with the user's optimum features and characteristics in one model.

Compounding this difficulty is the fact that, it is estimated that 70% of women have difficulty with their proper bra measurement and selection, even where a specific configuration of bra garment may be available to them. Even where women purchasers know their size and happen to be lucky enough to have a bra garment with the proper configuration for the subtle details in their size, it still can be very difficult to buy fashionable and well fitting clothes.

Many women's bra clothing items use bra or cup size measurements to distinguish differences in fit, but differences between bra models can be significant. Even further compounding this problem is that of habit. When a wearer finds a size and brand which fits well, there is a tendency to continue purchasing and relying on that brand regardless of how subtle or severely the body changes. This is because a woman's breasts change significantly over time, particularly during and after pregnancy. Other factors include weight loss, weight gain and monthly cycle body weight variations, all of which can have an effect on the fit of a bra. It has been suggested that bra wearers consciously check their bra size once or twice a year to detect mis fit due to significant weight changes.

One method of sizing involves simply first determining a bra band size as the rib cage circumference measurement, and then add 5 inches to that measurement to determine the band size. The second step is to perform a full circumferential measurement around the chest at the height of the fullest part of the breast, and then attempting to estimate a cup size by using the difference between the bra band size (which includes the five inches added) minus and circumference measured at the fullest part of the breast.

A chart is typically used which includes corresponding cup sizes including: half inch=AA; one inch=A; two inches=B; three inches=C; four inches=D; five inches=DD; six inches=E; seven inches=F; and eight inches=G. However, this bra measuring system upon which most ratioed sizes will not work optimally for more than some wearers. Bra manufacturers make assumptions based upon chest girth, cup separation, cup shape and depth and more. In fact, some manufacturers try to assemble the bras based upon an ambiguous combination of bra band sizes and cup sizes as follows: (1) Bra band sizes 32-28 may require: "Slender" build: A cup; "Average" build: B cup; "Heavier" build: C cup; (2) Bra band sizes 40-42 may require: "Average" build: B cup; "Heavier" build: C-D cup; (3) Bra band sizes 44-46 may require: "Average" build: C cup; "Heavier" build: D-DD cup.

Thus, it is clear that these types of approximate characterization are a tacit admission that even if the measurements ARE accurate, there are no real "standards" for bra sizing, and the manufacturers set their own dimensional standards, hoping to ratio up and down for a given size in the hopes that most users fall evenly within some range for each aspect of the bras provided.

Users who buy any type of bra appliance are not likely to be enabled to select an item which is optimized to the user's fit, including cup shape, under wire shape, cup thickness/thinness of material, cut of the cup, separation between the cups (the length difference between cups), length modifiable main strap (such as material, elasticity of material, and strap width, to name a few) and much more. In cases where a user is statistically outside the main averages (design assumptions) within bras are constructed are simply out of luck. In extreme cases users can have their bras tailored, which is an expensive proposition which still may not result in the correct construction, even after several iterations with a custom tailor.

Further, the best fit may involve having a user wear the bra for a few hours in a private setting, especially in the home. Many retail outlets either will not let user's try on the bra underwear or discourage on-site customer fittings. Some bras are specially packaged such that opening the package destroys the packaging. In these cases, a bra which is tried on will likely end up not on the main display shelves and either be returned to the factory or wasted.

The above problems are extremely grave for people for whom an ill fitting bra is a major inconvenience. Other, lesser problems can involve the compatibility of a bra with outer wear. The cut of the cups, the thickness of the shoulder straps and the material of the main strap needs to be compatible with the outer wear chosen. Bras having low upper cup edges are needed for low cut dresses. Even for a given style of dress, further optimization can be desired by the user as to how they chose for their bust line to appear with regard to the dress, including a flattening effect or at the other end of the spectrum, a push-up effect. Color is another subtle factor. Sometimes a dark bra material is needed for dark clothing and sometimes a light bra material is needed for light clothing. Clothing which is partially see-through, or which is tight fitting, as well as loose fitting, can present other compatibility problems. In many cases, the user is faced with the possibility of having to select an uncomfortable garment simply because it "goes with" a particular outer wear item.

For all of the above reasons, it is clear that no currently available bra appliance is available which can meet this diverse number of problems and needs of the consumer and wearer. What is needed is a system which enables quick and easy user customization, not only with respect to individual fit, but also for color, shape and outer wear compatibility.

SUMMARY OF THE INVENTION

A user selectable interchangeable bra system enables user to customize the selection, style, construction, and usage of a bra both through component purchase and interchangeable fit. Selection can be had with respect to the cup by selecting its size, shape, its cut, and in particular its upper shape and extent, its underwire presence or absence, as well as underwire interchangeableness. The center connector can be selected to provide for user selectable cup separation. Buckle type shoulder strap fittings can be provided with a tiny loop to support body jewelry, and because the shoulder straps are reversible, the body jewelry can be worn on the front or back upper chest, especially where the jewelry can appear to come from underneath the dress to give an appearance of a much more extensive jewelry extent.

The beginnings of the selection and customization can begin at the at the point of purchase, with the user buying components for mix and match employment within the bra system. It is expected that no component purchased will be wasted as it can either be employed for interfit into one aspect of a user constructed bra, or held for future use in a different configuration. Further, as a user begins trying a number of component parts in various combinations, the user will gain a better idea of which component parts might be selected in a completely different configuration. For example, where the user wants a full coverage cup for athletic activity, the user might also select a wider band and a closer connection between the cups. For evening wear, the user might select more abbreviated coverage cups, perhaps even having a lesser amount of material near the center, and then combine the constructed bra to have a longer center connector.

The user can vary and even omit components illustrated in the bra system. When wearing an evening dress which does not cover one shoulder, the shoulder strap associated with that shoulder can simply be omitted. Further, since the cups are interchangeable, the user in that example could choose a full cup for one side and a reduced area cup for the side of the body with the exposed shoulder.

Even with the selection only of colors, the user can select colors to be compatible with outer wear, and are not limited to one color. A colorful see-through blouse might be accented by a bra having different colors for each shoulder strap, each band portion, each cup and its back and front connectors, not to mention a selection of jewelry for which the bra of the bra system described herein is equipped to accept.

Further, the materials of construction of the bra of this bra system, in combination with the hook connectors are set to enable quick change, but long wear and disconnect resistance. The degree of time and effort spent in creating new bra combinations can be finished once an optimum combination is achieved, and thereafter the user can treat that bra as a completed single bra with no further changes. In this case, the bra can be washed, dried and continue in service the same as any other non-custom built, factory available bra.

As familiarity with the components of the system is increased, and where the user has time, the continued mix and match exploration can proceed without the need to ever form what the user considers a complete and permanent bra solution. After wearing, the user can simply launder the bra, and dis-assemble it to its component parts and return the components to the user's full set of components collection awaiting further creative bra construction.

It is of great advantage that the interchangeableness and further customization of the user can occur at home based upon the total number of different types of components available to the user. This solves many of the disadvantages in conventional design in the market. However, the use of a multi-component bra having a hook and eye tape design to hold it in place, yet to enable manual manipulation, also means that the user can choose to put-on and take off the bra from any point that the components can be manually separated. Thus, the user can unfasten the bra from between the front cups, or from the back, or from one side at the point of connection of one of the main straps and the cup. Thus, not only are all users presented with many ways to affix and un-do the bra of the invention, many people who favor one method over another due to injury, disability and the like can more easily dress and undress. For example, some people have limited arm movements and they can select the method of securing and un-securing the bra depending upon the best method their abilities will allow. Moreover, if those abilities change, the user can simply changed the location of the best point at which the bra is secured and unsecured. Further, the ability to quickly secure and un-secure the bra can assist the user by better enabling removal, adjustment (perhaps of the shoulder straps) then re-securing. Not all users may have enough arm movement to adjust the shoulder straps while the bra is in place, and secured on the body.

Further, the bra system described herein does not have so very many parts that it forces the user to the cut and sew level. The components include cups, side straps, rear center connectors, front connectors, shoulder straps and shoulder strap buckle jewelry connectors (optional). All of the components are units which enable the user to have the maximum choice in substitution for fit, securing and un-securing, and color effect, but without causing the user to have to resort to cutting, sewing, or even the use of any special tools.

To overcome the weakness of current commercially available bra designs, a comfortable and flexible bra with plenty of varied accessories is provided for the user to build their customized bra for their special needs and design. The main component parts of the invention sufficient to construct one completed bra includes: (1) a pair of cups, (2) a connection accessory for center-front joining between the pair of cups, (3) a pair of main strap portions which are each used to connect between cup and a back connector which may be a hook and Eye tape to name but one of many, (4) a pair of shoulder strap is used to connect between upper part of cup and the main wing elastic portions, the shoulder strap being preferably length adjustable, although the length adjustment strap and buckle can be replaced by a single solid strap, especially where a plurality of such solid straps are available for use by the user, (5) Other connectivity and decorative parts that can be taken down or assembled easily and separately, (6) an optional bra wire, which may have many shapes, strengths and curvature characteristics which may be, at the user's option, installed in a formed pipeline at the under wire portion of each of the cups. Where the user has a choice from among several bra wire shapes, several different shapes can be impressed on the cup and several different looks and different fits can be obtained for the cups.

It is preferable for there to be available a wide variety of different parts of different shapes, sizes and colors so that user's can make very fine adjustments to the size and configuration of the resulting constructed bra. The production of individual and separate parts of bra accessories which are specially designed to enable customers and user to create different style of bra with choosing different cups, wing elastic, shoulder strap, underwire and ornaments and more. Based on the user's body shape and depending upon the user's whims and the occasion, the user can replace suitable accessories easily to meet their functional needs, and where the user finds a configuration of highest utility, can construct several bras by duplicating the components of the bra of greatest utility or best fit. This can be done without having to buy a series of different styles of different bra sets, with the hope of that the optimum can be obtained.

Any resulting design undressed by the front connective accessory or hook or rear eye tape, or even where the side straps meet the cup, for greater convenience. A front center connector functions not only as an ornament, but also design for the comfortable joining of the cups. As compared with direct connection between cups at the centre-front, this accessory and joining structure can regard as a better junction and better fit the design of human system engineering, which does produce physical stress against the body at the center-front. Unlike a traditional bra, these individual components and accessories can be sold individually or in package, and in which the customers get the different style of the parts easily and can let them to build their own bra.

A hook and eye tape is connected with the wing elastic by additional hook and eye members which make a more secure connection, not dependent upon tension as is the hook and eye tape. For attachment to the edge of the hook and eye tape are further hooks, which can be used to hook the eye of the hook and eye tape at the edge of the wing elastic. Therefore, the user can choose different size, color, style and design of the hook and eye tape for fitting their body and matching their outer garment.

The wing elastic may include a pair of cup connecting side straps and may be made of any material such as a ruffle material on the top of elastic. The elasticity is fit with a larger elongation to give the users extra comfort to their back. This structure may have better expanding and contracting properties. Also, the elasticity is not so strong that it fails to give the users extra pressure to their back. It meets the human system engineering.

Connection accessories may include a W shape slide connector at the center-front. This W shape slide is a junction between cups at the center-front that connect these 2 cups together. W shape slide contains higher stability. It is difficult to disentangle and become deformed. The user can fine-tune the distance between the cups at the center-front to fit their body shape by choosing different size and design of W shape slide.

To improve the connection stability and ensure that the connection accessories do not disengage or deform easily, it may be preferable to use a "9" shaped slide for connecting the junction between wing elastic, shoulder strap and cup. The shape of the "9" shaped slide for the junction in shoulder strap has a portion which has a triangle shape, including a separating overhang. It also contains a barb shaped structure at the hook and jutting part inside the hook part, which is used, in combination with the material of the cup connectors to prevent the slipping of shoulder strap.

The ability to optionally assemble a pre-specified bra wire provides a great many some benefits. The customers can choose and replace the wire easily. Also, it can reduce the chance of corrosion and deformation of the cup when the customers take care to remove the wire before washing the bra.

The shoulder strap may use an "8" shaped slide to adjust the length and form a handy attachment for an ornament. It can help support an ornamental chain or other decorations. The shoulder strap is reversible and thus at the wearer's front, it can appear as if a wider and more gently draping necklace or other ornament is present, especially as attached to the "8" shaped slide by a hook or semi circular eyelet connector, to improve the appearance of the bra design and the user.

The design of the system is multi-functional and structurally utilizable. It is designed for the user to choose the suitable parts and accessories and assemble different style and design of the bra. Since it does not require stitching or special tools to attach the parts, the process of producing a bra for personal use is simplified and the efficiency is improved. The overall design is also considered to give the user maximum flexibility in selecting components which can provide for good feeling and comfort of the user. Moreover the resulting design is stable. The design and materials prevent deformation and disentanglement. Based on the actual needs and requirement, the number of basic accessories can be adjusted to give the user advantages including advantages of variety, selectivity, comfort, and stability. Compared with conventionally available bra designs, this design includes an essential characteristic and improvement.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
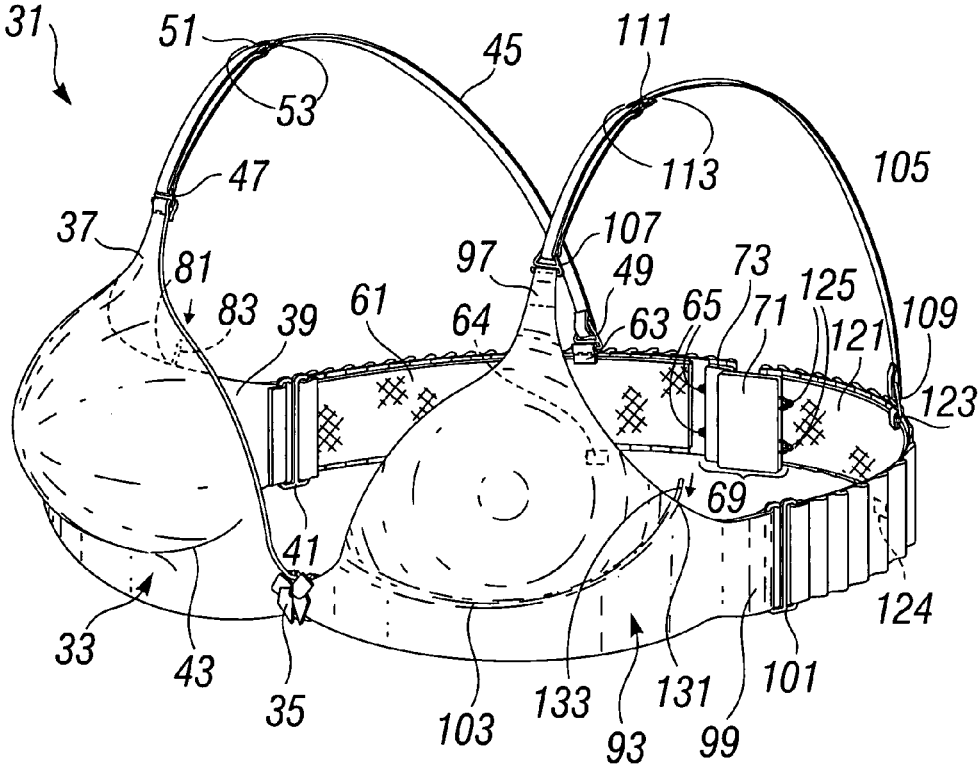
FIG. 1 is a perspective view of the upper front of the bra structure of the invention, as well as the connectivity of components at the rear of the bra, and including the connectors, and the locations into which the underwire component can be inserted.

Referring to FIG. 1, is a perspective view taken from an upper front perspective of a user assembled bra 31 of the invention is useful in illustrating the components and interconnectivity of the components thereof. The self assembled bra 31 includes a first cup assembly 33 (which is seen as a ¾ area or ¾ extent cup) which includes extent sufficient to reach a center connector having a bow 35, and upper extension 37, and a lateral outward extent 39 sufficient to accept engagement with a main side strap connector 39 which may be a hook connector. A shadow line 43 illustrates that the cup assembly 33 may have a pre formed outer extent. The inner extent can be different from the outer extent to add form and shape, including the potential addition of supplementary form. The upper extension 37 and the lateral extension 39 helps to remove the points of connection from areas so closely adjacent to the central area of the cup assembly 33. The formed shape of the central portion of the first cup assembly 33, coupled with the extent of the upper extension 37 and the lateral extension 39 helps to give the user assembled bra 31 a much more finished appearance.

As will be shown more fully, the center connector having a bow 35 is a decorative structure which hides the extent of a double connector to be shown later. The use of the center connector having a bow 35 to hide the connector gives the user assembled bra 31 a more professional appearance, as if it were a factory constructed bra. Further, the lateral width of the center connector located at the center-front having a bow 35 or other decorative item or omitting such decorative item can be of different widths to provide different cup separations.

A right shoulder strap 45 is seen as having a pair of connection members 47 and 49. The right shoulder strap 45 is shown as doubled between the connection member 47 and an "8" shaped buckle fitting 51. Buckle fitting 51 may have a very tiny lateral eyelet 53 which is seen on buckle fitting 51 as a tiny bump. The buckle fitting 51 may have multiples eyelets 53. The connection members 47 and 49 are seen as "9" shaped members which fit through openings in material into which they are attached. Upper extension 37 provides a channel in the material through which a lower hook member in the connection member 47 passes.

At the left side of the first cup assembly 33, the fitting 41 is seen as having a lower hook shape which passes through a portion of the material of the lateral outward extent 39 of the first cup assembly 33. The other side of the fitting 41 is attached to a first main strap 61. At the side and rear of the first main strap 61, a small cloth loop connector 63 is attached to optionally extend slightly from the upper edge of the first main strap 61 and is shown as being engaged by the connection member 49. A second small cloth loop connector 64 may lie opposite the small cloth loop connector 63 where it is desired to enable the first main strap 61 to be completely reversible. Complete reversibility means that first main strap 61 can occupy either side of the user assembled bra 31.

In the configuration shown, the connection members 47 and 49 are shown as being engaged in a position where the lower extension members of the are extending toward the centerline of the user assembled bra 31, but they can extend in either direction. Moreover, where right shoulder strap 45 has its connection members 47 and 49 with oppositely oriented lower extension members, the right shoulder strap 45 will be universal to thus eliminate the need for left and right mirror image bra straps.

At the end of the first main strap 61 near the center back, a pair of hook connectors 65 are seen engaging a pair of eye connectors (not directly show in FIG. 1) to attach a joining tape as a hook and eye tape 69 to the first main strap 61. The hook and eye tape 69 is a complete connector set with an eye tape portion 71 shown as connected to the first main strap 61 and also to a hook tape portion 73.

The completely replaceable hook and eye tape 69 enables a user to select different colors, and lengths (lateral widths) of hook and eye tape 69 to fit even where all of the other components of the user assembled bra 31 are the same. Take as an example a user who finds all components of the user assembled bra 31 to be comfortable, but only needs additional dimension about the main extent of the circumference of the main extent of the user assembled bra 31. The selection of a larger hook and eye tape 69 is all that is needed, and it can be easily substituted. Further, the opposite side of the of hook and eye tape 69 can have a decoration similar or different from bow 35, such as a flower or other decorative design. As such, the hook and eye tape 69 can be changed out to give different effects to the rear of the user assembled bra 31.

Also seen in FIG. 1 is an underwire support 81 shown next to a directional arrow illustrating that the underwire support 81 can be inserted into the first cup assembly 33 in a specially provided channel, as will be shown. Typically the underwire support 81 is a curved length of flexible metal or plastic having a cross sectional shape ranging from rectangular to polygonal to round. In advanced models of the underwire support 81, the flexibility can be linearly or step-wise distributed along the length, and other dimensional aspects can be formed into the final underwire support 81. To prevent any damage to the material of the first cup assembly 33, a coating 83, which may be limited to areas near the ends of the underwire support 81, are illustrated.

The other half of the user assembled bra 31 includes components which are bilaterally related to the components described, including second cup assembly 93, upper extension 97, lateral outward extent 99, second connector 101, shadow line 103, left shoulder strap 105, pair of connection members 107 and 109, "8" shaped buckle fitting 111, multiple eyelets 113, second main strap 121 (which may be identical to first main strap 61 where its reversible), small cloth loop connector 123 and small cloth loop connector 124, pair of hook connectors 125 (supported by second main strap 121), pair of eye connectors (supported by eye tape portion 71, but not directly shown in FIG. 1), underwire support 131 with coating 133. As before, the first and second main straps 61 and 121 may be identical and reversible, and the right wing elastic 45 and left shoulder strap 105 can also be identical and reversible. The components above indicated as being attached and un-attached can be disassembled separately and assembled freely. User can buy different accessories separately from the shop, including components of different sizes, including first cup assembly 33 and second cup assembly 93 for different dresses, different clothing needs and color coordination. Preferably, the components outlined above will be available separately, to maximize the number of component combinations possible for purchase.

Figure 2:
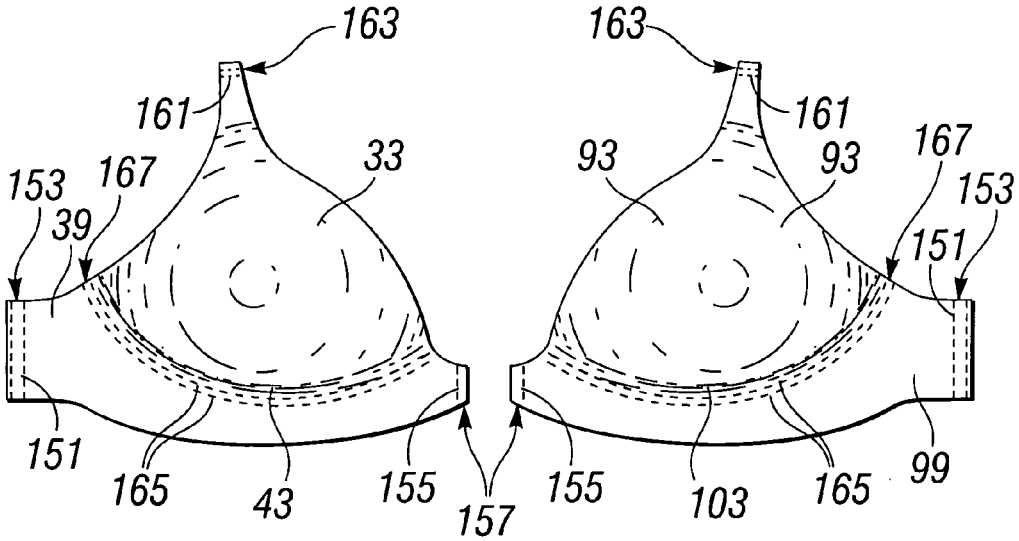
FIG. 2 is a frontal plan view illustrating two cups members with dashed line format illustrating the internal passageways through which components can be stably inserted to for connection of the cup members to each other, the main straps, the underwire insertion and the shoulder strap connectors.

Referring to FIG. 2 a frontal plan view illustrating the first and second cup assemblies 33 and 93 as seen in FIG. 1 are shown with dashed line format illustrating the boundary for internal passageways through which components can be stably inserted to for connection of the first and second cup assemblies 33 and 93. The internal passageways can be formed by cutting, by gluing adjacent the folds of material, or by sewing, to name but a few methods of forming such passages.

Referring to both the first and second cup assemblies 33 and 93, a boundary 151 is seen to form a through passage 153 through which the extension members of the connectors 41 and 101 may extend to enable engagement of the first and second main straps 61 and 121 to the first and second cup assemblies 33 and 93. A boundary 155 is seen to form a through passage 157 through which the extension members (to be shown later) of the a center connector having a bow 35, will extend to enable engagement of the first and second cup assemblies 33 and 93 to each other. A boundary 161 is seen to form a through passage 163 through which the connection members 47 and 107 may extend to enable engagement of the right and left shoulder straps 45 and 105 to the first and second cup assemblies 33 and 93.

Just below the shadow lines 43 and 102 a pair of boundary lines 165 form a pipeline or bore 167 into which the underwire supports 81 and 131 can be inserted. Because the underwire supports 81 and 131 are made of metal, their insertion will control a resulting shape of the shadow lines 43 and 103. The shadow lines are nothing more than a resulting shape of the general under breast supporting shape of the first and second cup assemblies 33 and 93. Other shape indicators can be referred to for a visual change in the support shape of the first and second cup assemblies 33 and 93, with the shadow lines 43 and 103 being simply one method to verbally illustrate the effect of the use of the first and second cup assemblies 33 and 93. The underwire supports 81 and 131 can not only have a differential flexibility along their length to "give" in the direction normal to the body of the user, but will normally have a changing curvature or radius along the length of the underwire supports 81 and 131. This enables the user to change the shape of the first and second cup assemblies 33 and 93, and especially effect movement along the lower part of the first and second cup assemblies 33 and 93 with a gentler change in shape at the shadow lines 43 and 103 due to the separation of the shadow lines 43 and 103 from the bore 167 into which the underwire supports 81 and 131 will be inserted. The curvature of the underwire supports 81 and 131 can significantly deviate from the path of the bore 167 shown. Further, different ones of the first and second cup assemblies 33 and 93 can have different shaped paths for the bore 167. Further, with some shapes and configurations of the first and second cup assemblies 33 and 93, multiple bores 167 can be formed so that the underwire supports 81 and 131 can be inserted in different locations. Further, multiple bores 167 can branch out from a single opening. In addition, it should be noted that the bores 167 seem to terminate just short of the bilaterally innermost extent of their length and this may or may not be so. Thus, the bores 167 can extend completely through or may be in place as a blind bore. Regardless, the friction of placement of the underwire supports 81 and 131 are typically enough to keep them in place regardless of the amount of the user's movements.

Figure 3A:
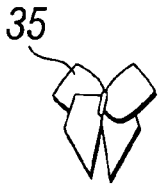
FIG. 3A illustrates a front view of a bow design which mounts onto a double hook connector used to join the two cup members seen in FIG. 2.
Figure 3B:
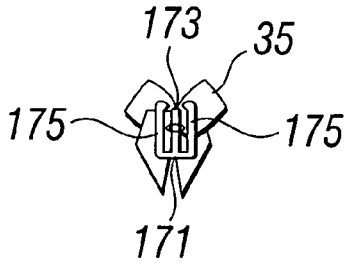
FIG. 3B illustrates a rear view of the bow design seen in FIG. 3A and which illustrates the bow attachment to the front of the double hook connector and illustrates a pair of oppositely oriented engagement members.
Figure 3C:
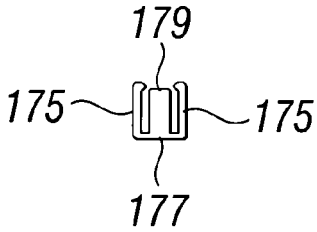
FIG. 3C illustrates an attachment member similar to that seen in FIG. 3B, but having a wider dimension.

Further views related to the details of the first embodiment seen in FIGS. 1 and 2 will be illustrated in the further figures. FIG. 3A illustrates an expanded front view of the bow design seen in FIG. 1 and which covers the double hook connector used to join the first and second cup assemblies 33 and 93. FIG. 3B illustrates a rear view of the bow 35 seen in FIG. 3A and which illustrates the bow 35 attachment to a double hook connector 171 having a central tine 173. Extending from one end of the central tine 173 are a pair of spaced apart oppositely oriented engagement members 175 having curved ends to enable stable engagement with the through passages 157 of the first and second cup assemblies 33 and 93 to join them together when forming the user assembled bra 31 seen in FIG. 1. The pair of spaced apart oppositely oriented engagement members 175 can be inserted with an upward or downward orientation with respect to the first and second cup assemblies 33 and 93 to join them together. The spacing between the pair of spaced apart oppositely oriented engagement members 175 can be large or small so that the joined location of the first and second cup assemblies 33 and 93 can be varied. Referring to FIG. 3C, a wider hook 177 member is shown as having a much wider center tine 179 which may provide additional width and support to an ornamental decoration.

Figure 4A:
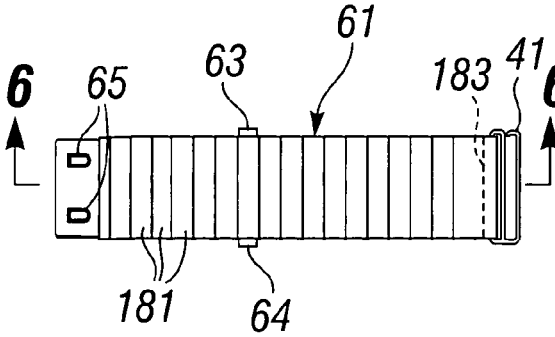
FIG. 4A illustrates one of a pair of side straps which includes an attached hook, bra strap eyelet material, and a pair of flat hook connectors.

Referring to FIG. 4A one of a pair of side straps is seen from the outside surface and illustrates further details thereof. A front view of the pair of hook connectors 65 is seen, which is able to engage matching eyelets on one of an eye tape portion 71 and hook tape portion 73. The ability to reverse the serial orientation of the eye tape portion 71 and hook tape portion 73 will enable right handers and left handers to flip the orientation of the hook and eye tape 69 to enable left and right hand rear opening and closing operation. The hook connectors 65, as well as the hook connectors 125 are expected to have a tighter tolerance in order to hold the hook and eye tape 69 by virtue of more than a tension engagement. The hook and eye tape 69 may have much wider tolerance to limit itself to holding on tension engagement only.

Also seen in expanded format are the small cloth loop connectors 63 and 64 which can permit the first main strap 61 to be reversible. Also seen are a series of folds 181 of an outer layer of material which enable a non elastic length of material to be used as a covering which is attached to an underlying layer of elastic material (not seen in FIG. 4A). A dashed line 183 illustrates the sewing line which surrounds and traps a portion of the connector 41.

Figure 4B:
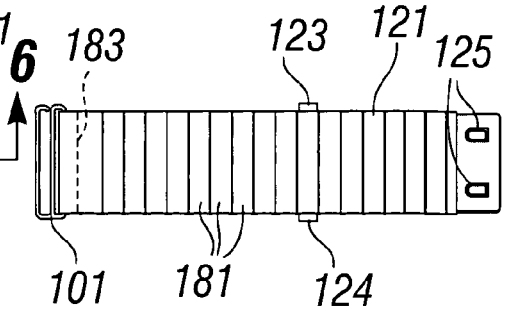
FIG. 4B illustrates the other one of a pair of side straps which includes an attached hook, bra strap eyelet material, and a pair of flat hook connectors, and which may be a mirror image or identical with the strap seen in FIG. 4A.

Likewise, referring to FIG. 4B, the other of a pair of main straps is seen as a second main strap and illustrates many of the same features seen in FIG. 4A. A front view of the pair of hook connectors 65 is seen, which is able to engage matching eyelets on one of an eye tape portion 71 and hook tape portion 73. The ability to reverse the serial orientation of the eye tape portion 71 and hook tape portion 73 will enable right handers and left handers to flip the orientation of the hook and eye tape 69 to enable left and right hand rear opening and closing operation. Other structures are the same as were seen in FIG. 4A and are so labeled. It is to be noted that although the orientation of both the connectors 41 and 101 show them as being hooked upwardly with respect to the first and second cup assemblies 33 and 93, that either orientation is acceptable, and wherein a main strap 61 is reversible, the same main strap 61 could be used for both the first and second main straps 71 and 121. However, as will be shown, the presence of a finished side, including the folds 181 will compromise reversibility.

Figure 5:
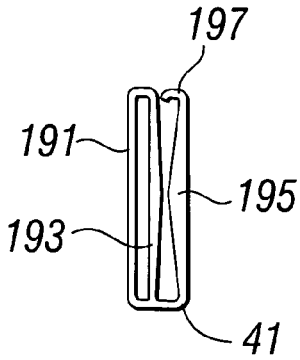
FIG. 5 is an expanded view of the connector seen on the straps of FIGS. 4A and 4B.

Referring to FIG. 5, an expanded view of one of the connectors 41 seen on the straps of FIG. 4A is shown. The connector has a closed structure 191 which includes an aperture 193 through which one end of the first and second main straps 71 and 121 will loop through and be joined to the material of the first and second main straps 71 and 121, respectively, to affix the connector 41 to it. An extension member 195 extends from one edge of the connector 41 and terminated in a hook 197. The hook 197 holds the extension member 195 within the through passage 153 to make the resulting user assembled bra 31 stably assembled.

Figure 6:
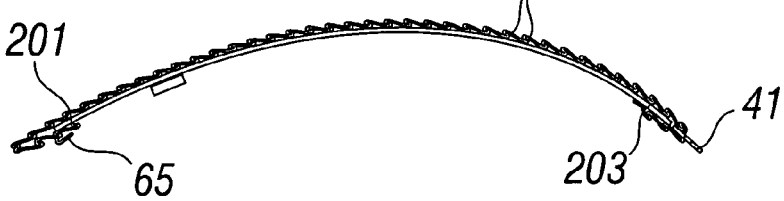
FIG. 6 is a view looking down onto the strap seen in FIG. 4 which illustrates the low profile of the end hooks and the use of a covering overlap layer to enable a smooth finish and which is attached to an elastic layer.

Referring to FIG. 6, a view looking upward along line 6-6 of FIG. 4 illustrates the orientation of the folds 181 as belonging to a non-elastic finished layer 201 which is attached onto an elastic layer 203. Notice that the elastic layer 203 is brought through the connector 41 and re attached back onto the elastic layer 203. The pair of hook connectors 65 are seen as extending from the same side of first main strap 61 as the finished layer 201.

Figure 7A:
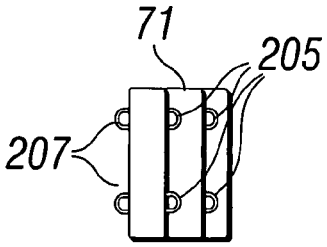
FIG. 7A is a view of the female side of a hook tape with the hook eyes facing the observer and which can be employed on either side of the main bra straps of the invention.

FIG. 7A is a view of the female side of hook tape portion 71 with the hook eyes facing the observer and which can be employed on either side of the first and second main bra straps 61 and 121. The hook tape portion 71 is shown with two columns of eye connectors 205, although it may have from one to 5. Given the fact that the user may have a selection of the lengths of the eye tape portion 71, as well as the length of the hook tape portion 73, the user can select different sizes of single column connectors to give minimum material needed for a comfortable fit. A pair of end eye connectors 207 are provided to attach to one of the pair of hook connectors 65 or 125.

Figure 7B:
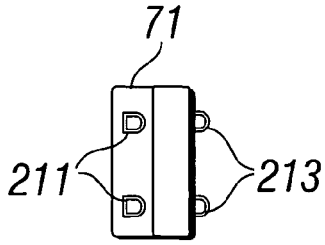
FIG. 7B is a view of the male side of a hook tape with the hook eyes facing the observer and which can also be employed on either side of the main bra straps of the invention.

Referring to FIG. 7B, a view of the male connector side of a hook tape 73 illustrates a single column of hook tape hooks 211, which is believed to be optimal for connection with any column of the eye connectors 205 seen in FIG. 7A. A pair of end eye connectors 213 are provided to attach to one of the pair of hook connectors 65 or 125.

Figure 8A:
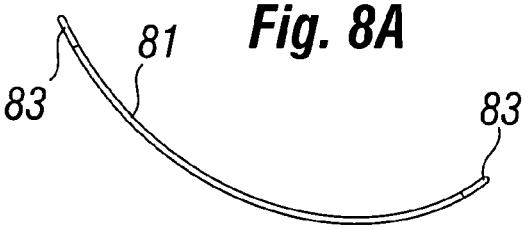
FIG. 8A is a plan view of a bra cup underwire having a protective coating applied to the ends to facilitate insertion into the bra under-cup with either end going in first.
Figure 8B:
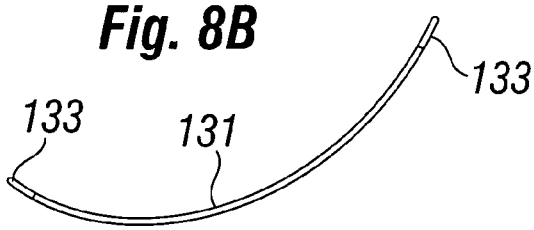
FIG. 8B is a reverse view of the bra cup underwire as in FIG. 8A.

Referring to FIG. 8A, a plan view of bra cup underwire 81 having a protective coating 83 applied to the ends to facilitate insertion into the bra under-cup with either end going in first. Similarly, FIG. 8B illustrates a plan view of bra cup underwire 131 having a protective coating 133 applied to the ends.

Figure 9A:
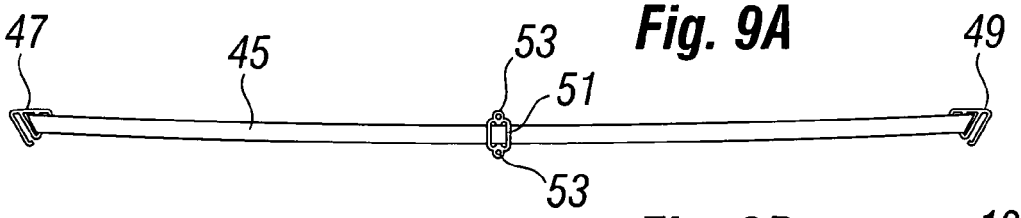
FIG. 9A is a view of a bra shoulder strap with a buckle adjustment mechanism having an eyelet to one side.
Figure 9B:
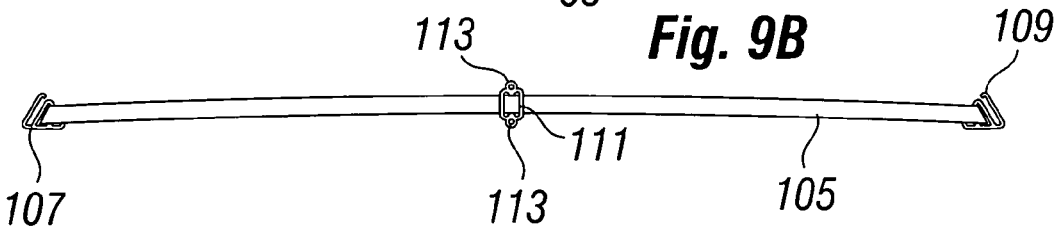
FIG. 9B is a view of a bra shoulder strap with a buckle adjustment mechanism having an eyelet on both sides.

Referring to FIG. 9A, a view of the right bra shoulder strap 45 with a buckle adjustment 53 having an eyelet 53 on either side. FIG. 9B is a view of the left bra shoulder strap 105 with a buckle adjustment 111, and in addition, connection member 109 is shown oriented oppositely with respect to connection member 107 to illustrate the possibilities for reversibility.

Figure 10:
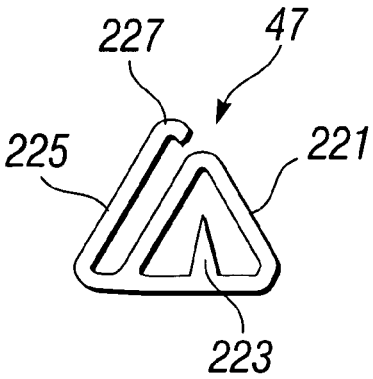
FIG. 10 is a plan view of a first embodiment of a bra strap connector.

Referring to FIG. 10, a plan view of connection member 47 illustrates one set of structures which may be employed as a connection member 47 and which is sometimes referred to as a "9" slide. A closed connector 221 may include a center insertion member 223 which can be used to bifurcate the enclosed area formed by the closed connector 221, An extension member 225 extends from any part of the closed connector member 221, and terminates in a hook portion 227.

Figure 11:
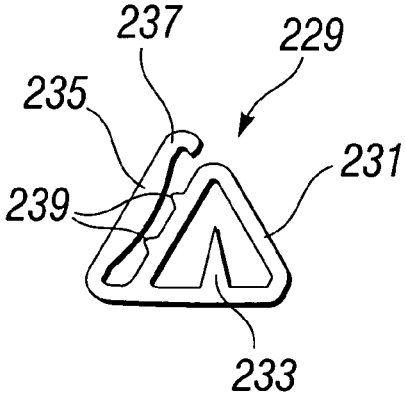
FIG. 11 is a plan view of a second embodiment of a bra strap connector.

Likewise, referring to FIG. 11, a plan view of a second version of a connection member 47 is seen as a connection member 229 and which has many of the same components and structures seen in FIG. 10, including a closed connector 231, center insertion member 233, extension member 235, and hook portion 237. In addition, an outer section of the closed connector 221 opposite the extension member 235 may have a pair or extensions 239 to help produce further tension in any member passed in between the extension member 235 and the closed connector 221.

Figure 12A:
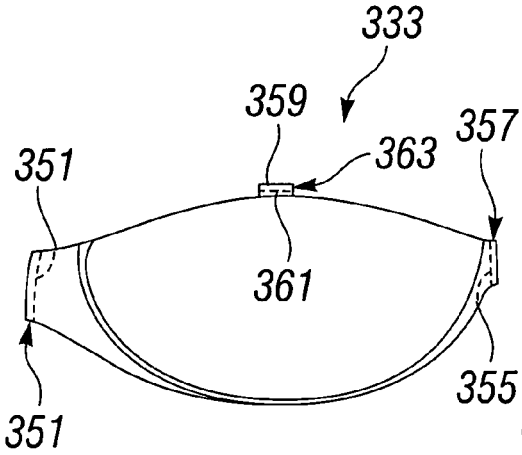
FIG. 12A is a plan view of a right cup of a second embodiment showing different configurations for attachment.
Figure 12B:
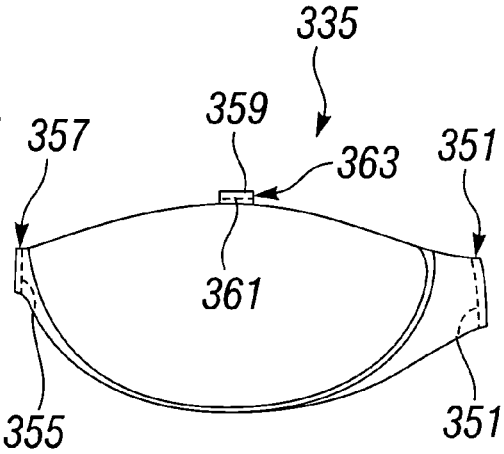
FIG. 12B is a corresponding plan view of a left cup corresponding to the right cup shown in FIG. 12A.

Referring to FIGS. 12A and 12B, a plan view of number of different components that may be employed in a second embodiment of a completed user assembled bra 31, are shown. A pair of oppositely situated half cups are seen as first cup assembly 333 and second cup assembly 335. Referring to both the first and second half cup assemblies 333 and 335, a boundary 351 is seen to form a through passage 353 through which the extension members of the connectors 41 and 101 may extend to enable engagement of the first and second main straps 61 and 121 to the first and second cup assemblies 333 and 335. A boundary 355 is seen to form a through passage 357 through which the extension members 175 of the a center connector 171, will extend to enable engagement of the first and second cup assemblies 333 and 335 to each other. A pair of extension 359 extend just above the first and second cup assemblies 333 and 335. The extension 359 may be a doubled expanse of material and includes a boundary 361 is seen to form a through passage 363 through which the connection members 47 and 107 may extend to enable engagement of the right and left shoulder straps 45 and 105 to the first and second cup assemblies 333 and 335.

Figure 13A:
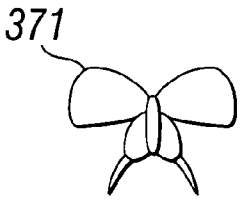
FIG. 13A illustrates a front view of a bow design which mounts onto a double hook connector used to join the two cup members seen in FIG. 12.
Figure 13B:
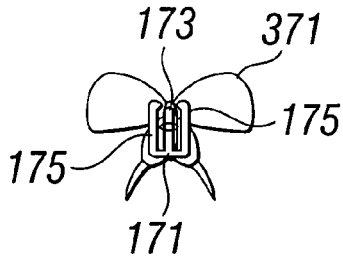
FIG. 13B illustrates a rear view of the bow design seen in FIG. 13A and which illustrates the bow attachment to the front of the double hook connector and illustrates a pair of oppositely oriented engagement members.

Referring to FIG. 13A, an expanded front view of a different bow design is seen as a bow 371. Referring to FIG. 13B, a reverse view of the bow 371 of FIG. 13B illustrates the connector 171 previously seen in FIG. 3B.

Figure 14A:
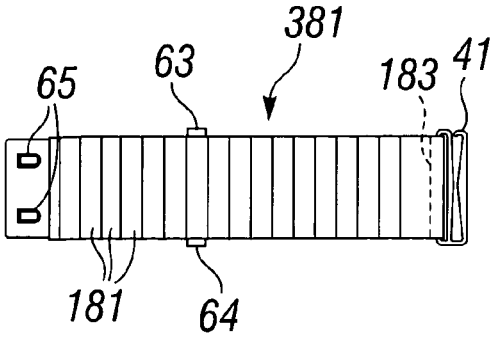
FIG. 14A illustrates one of a pair of plain side straps which includes an attached hook, bra strap eyelet material, and a pair of flat hook connectors.
Figure 14B:
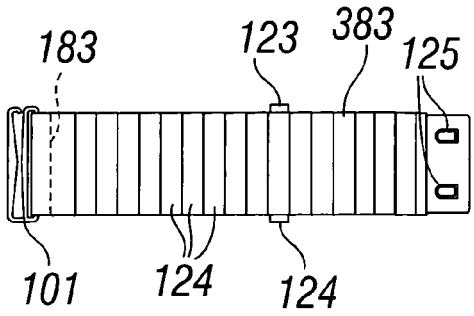
FIG. 14B illustrates the other one of a pair of plain side straps which includes an attached hook, bra strap eyelet material, and a pair of flat hook connectors, and which may be a mirror image or identical with the strap seen in FIG. 14A.

Referring to FIG. 14A one of a pair of side straps which are singly ply elastic and without a readily discernible finishing layer is seen as a first main strap 381 with the same components seen with respect to first main strap 61 of FIG. 4A. Likewise, FIG. 4B illustrates a second main strap 383 with the same components seen with respect to second main strap 121 of FIG. 4B.

Figure 15:
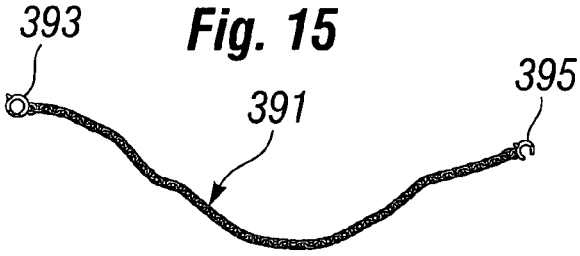
FIG. 15 is a one example of a chain ornament which can emulate a frontal or rearwardly worn jewelry accessory and which has mechanical clasps which can engage apertures carried on the adjustment buckles of the bra straps.

Referring to FIG. 15, an ornament is seen as a chain 391. The chain 391 may be provided as having different lengths and different ornamentation in the same way as any necklace, charm set or plain chain which may be worn around the neck or as a bracelet. At the ends of the chain 391 a set of connectors 393 and 395 are seen. As a result, if the user has other jewelry which can interconnect with the "8" shaped buckle fitting 51 or 111 multiple eyelets 53 or 113, it can be employed and supported by the user assembled bra 31. Since the shoulder straps 45 and 105 are reversible, the chain 391 or any other user jewelry can be displayed at the user's front or back. At the front, and especially with blouses and the like, the chain 391 or other jewelry will appear as a widely draping necklace. At the rear, especially with downwardly sweeping blouses or tank tops, the rearwardly exposed jewelry will appear to be attached nowhere as it extends from underneath the clothing.

Figure 16:
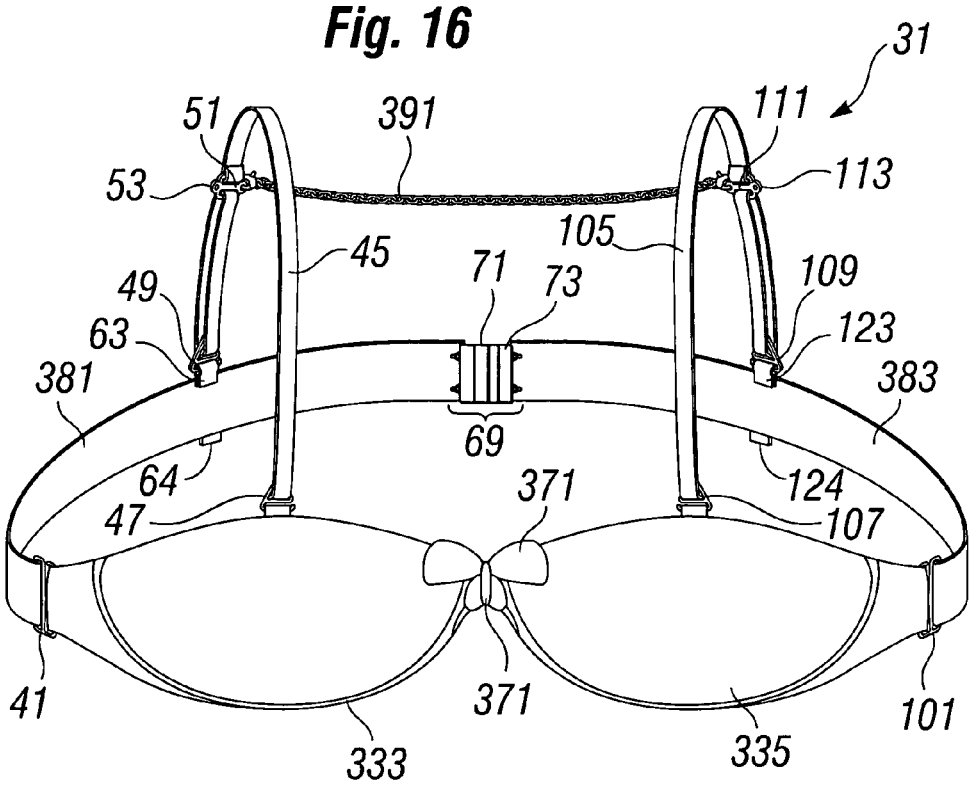
FIG. 16 is a perspective view of the upper front of the bra design structure of the invention, as well as the connectivity of components at the rear of the bra, and including the connectors.

Referring to FIG. 16, a further combination of the user assembled bra 31 is seen. The components are as previously described, although being a different combination of those components. The chain 391 is shown extending from the shoulder straps 45 and 105 at a location which would be rearward of the user's neck. The shoulder straps 45 and 105 can be reversed to place the "8" shaped buckle fittings 51 and 111, also known as slide fittings, at a location which would be forward of the user's neck such that the chain 391 may be worn somewhat as a gently looping necklace.

Figure 17:
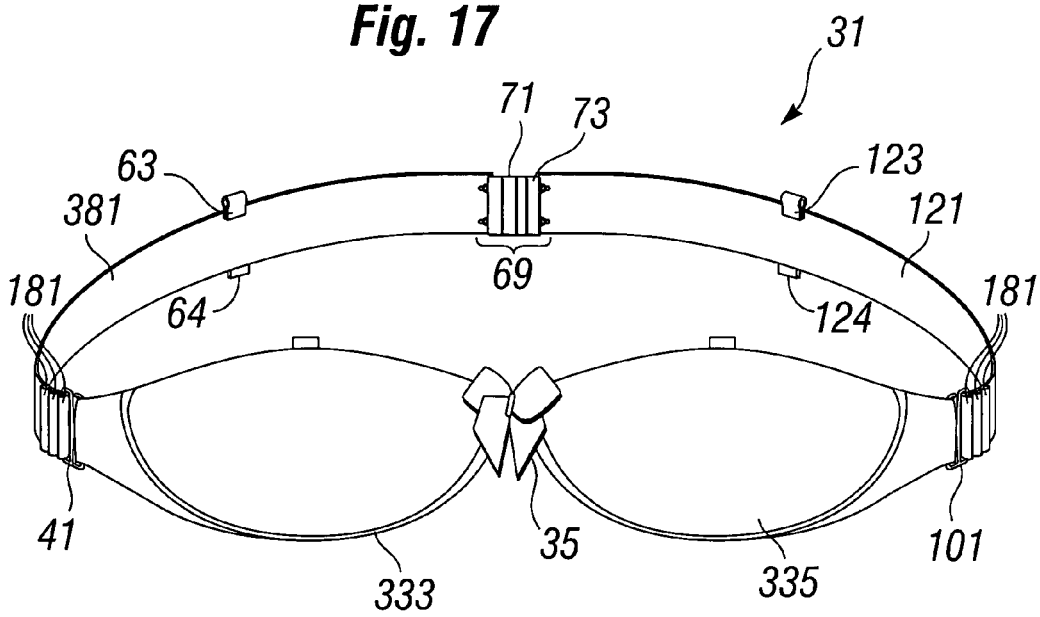
FIG. 17 is a frontal plan view of the lower cut bra of FIG. 16 shown without the supporting shoulder straps.

Referring to FIG. 17, a still different combination of components are used to form a user assembled bra 31, but without the shoulder straps 45 and 105 to be worn as a "strapless bra". Ideally the extension 359 would be either low profile or foldable into an area either behind or within their respective first and second cup assemblies 333 and 335 which would enable them to be comfortably out of sight. Likewise, first and second main straps 61 and 121 may be provided without any small cloth loop connectors 63, 64, 123, or 124 as well as vertically wider in construction to support the "strapless" look.

The user assembled bra 31 of the invention is designed for the user to assemble personal and different styles of bra by choosing accessories freely. The design is also very convenience to use since it can be put on or removed from the front or back of the user body. This invention is not limited to the very few and sparing above examples shown. The user can modify the number, size and color of related accessories to meet their needs.

While the present invention has been described in terms of a user customizable bra system of interconnected components, one skilled in the art will realize that the structure and techniques of the present invention can be applied to many appliances including any appliance which utilizes the embodiments of the instrumentation of the invention or any process which utilizes the steps of the invention.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed is:

1. A user assembled and component interchangeable bra system comprising:

a first cup assembly having a first center connector area and including a first through passage, and a first main strap connector area;

a second cup assembly having a second center connector area and including a second through passage, and a second main strap connector area;

a center connector for user selectable engagement to join the first cup assembly to the second cup assembly by direct engagement of said first center connector area to said second center connector area and for user selectable disengagement, the center connector having a pair of spaced apart engagement members including a first engagement member for engaging said first through passage and a second engagement member for engaging said second through passage, where the center connector can be removed from said first and said second cup assemblies by a movement generally in a direction along a length of said spaced apart engagement members, and wherein the center connector first engagement member has an enlarged first terminal end wider than a mid-length width and a second end and wherein said second engagement member has an enlarged first terminal end wider than a mid-length width and a second end commonly supported from said second end of said second engagement member and wherein said first engagement member is generally parallel to said second engagement member and wherein said first terminal end of said first engagement member and said first terminal end of said second engagement member are closer to each other than said second ends of said first and said second engagement members;

a first main strap having a first end for user selectable slip fit engagement adjacent the first main strap connector area of the first cup assembly for quick interchangeability, and a second end;

a second main strap having a first end for user selectable slip fit engagement adjacent the second main strap connector area of the second cup assembly for quick interchangeability, and a second end; and a joining tape assembly having a first end removably connected to the second end of the first main strap, and a second end removably connected to the second end of the second main strap, and wherein the first and second cup assemblies, center connector, first and second main straps and tape assembly are independently substitutable by a user so that the user is free to substitute different ones of the first and second cup assemblies, center connector, first and second main straps and tape assembly to user customize the bra system.

2. The user assembled and component interchangeable bra system comprising as recited in claim 1 wherein the first and second cup assemblies are half-cup assemblies.

3. The user assembled and component interchangeable bra system comprising as recited in claim 1 and further comprising a first shoulder strap for user selectable engagement between the first cup assembly and the first main strap at a position between the first and second end of the first main strap; and a second shoulder strap for user selectable engagement between the second cup assembly and the second main strap at a position between the first and second end of the second main strap.

4. The user assembled and component interchangeable bra system comprising as recited in claim 3 wherein the first and second cup assemblies are three-5quarter-cup assemblies for covering about three quarters of a human breast.

5. The user assembled and component interchangeable bra system comprising as recited in claim 3 wherein the first and second shoulder straps have buckle fittings for adjusting an effective length of the first and second shoulder straps, and where each buckle fitting has at least one eyelet for interfitting with a decorative object.

6. The user assembled and component interchangeable bra system comprising as recited in claim 5 wherein the buckle fitting is an "8" shaped buckle fitting.

7. The user assembled and component interchangeable bra system comprising as recited in claim 5 wherein the decorative object is a chain extending between the buckle fittings of the first and second shoulder straps.

8. The user assembled and component interchangeable bra system comprising as recited in claim 1 wherein the first and second main straps include a covering layer attached to an elastic layer.

9. The user assembled and component interchangeable bra system as recited in claim 1 wherein the center connector includes a decorative covering for facing away from the user and the first and second cup assemblies.

10. The user assembled and component interchangeable bra system as recited in claim 1 wherein the joining tape assembly is a hook and eye tape.

11. The user assembled and component interchangeable bra system as recited in claim 1 wherein the center connector for user selectable engagement to join the first cup assembly to the second cup assembly includes a tine extending between the pair of spaced apart engagement members.

* * * * *